US009420826B2

(12) United States Patent
Siminszky

(10) Patent No.: US 9,420,826 B2
(45) Date of Patent: Aug. 23, 2016

(54) METHODS FOR REDUCING THE FORMATION OF TOBACCO SPECIFIC NITROSAMINES IN TOBACCO HOMOGENATES

(75) Inventor: Balazs Siminszky, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 29 days.

(21) Appl. No.: 14/119,462

(22) PCT Filed: May 24, 2012

(86) PCT No.: PCT/EP2012/059696

§ 371 (c)(1), (2), (4) Date: Feb. 11, 2014

(87) PCT Pub. No.: WO2012/160133

PCT Pub. Date: Nov. 29, 2012

(65) Prior Publication Data

US 2014/0190499 A1 Jul. 10, 2014

(30) Foreign Application Priority Data

May 26, 2011 (EP) ..... 11004343

(51) Int. Cl.
*A24B 15/24* (2006.01)
*A24B 15/28* (2006.01)

(52) U.S. Cl.
CPC ..... *A24B 15/245* (2013.01); *A24B 15/28* (2013.01)

(58) Field of Classification Search
USPC ..... 131/290, 297, 2, 98, 347, 352, 370, 372
See application file for complete search history.

(56) References Cited

U.S. PATENT DOCUMENTS 6,508,254 B1 * 1/2003 Mua et al. ..... 131/297
6,564,808 B1 * 5/2003 Hempfling et al. ..... 131/297

(Continued)

FOREIGN PATENT DOCUMENTS

EP 1 782 702 5/2007
EP 2 011 408 1/2009

(Continued)

OTHER PUBLICATIONS

Definition of de novo, The Free Dictionary by Farlex, [online], retrieved Mar. 20, 2015, [retrieved from the Internet], <URL: http://www.thefreedictionary.com/de+ novo>.*
Burton et al, "Changes in Chemical Composition of Burley Tobacco during Senescence and Curing. 3. Tobacco-Specific Nitrosamines", J. Agric. Food Chem. 1989, 37,pp. 426-430.*
European Search Report dated Oct. 7, 2011 for EP Application No. 11004343.7- 1221 (7 pages).

(Continued)

*Primary Examiner* — Dennis Cordray
(74) *Attorney, Agent, or Firm* — Mueting, Raasch & Gebhardt, P.A.

(57) ABSTRACT

In one aspect, there is provided a method for reducing the formation of 4-(methylnitrosamino)-1-(3-pyridyl)-1-butanone and N-nitrosonornicotine and N-nitrosoanatabine and N-nitrosoanabasine in a tobacco homogenate comprising the steps of: (a) providing a tobacco homogenate; (b) increasing the pH of the tobacco homogenate to at least about pH 6.0; (c) optionally measuring the concentration of 4-(methylnitrosamino)-1-(3-pyridyl)-1-butanone and N-nitrosonornicotine and N-nitrosoanatabine and N-nitrosoanabasine in the tobacco homogenate before and after the pH treatment in step (b); and (d) obtaining a tobacco homogenate in which the levels of 4-(methylnitrosamino)-1-(3-pyridyl)-1-butanone and N-nitrosonornicotine and N-nitrosoanatabine and N-nitrosoanabasine are reduced as compared to the levels of 4-(methylnitrosamino)-1-(3-pyridyl)-1-butanone and N-nitrosonornicotine and N-nitrosoanatabine and N-nitrosoanabasine in the tobacco homogenate provided in step (a).

16 Claims, 2 Drawing Sheets

(56) References Cited

U.S. PATENT DOCUMENTS

| | | | | |
|---|---|---|---|---|
| 2005/0039767 | A1* | 2/2005 | Mua et al. | 131/370 |
| 2008/0029110 | A1* | 2/2008 | Dube et al. | 131/275 |
| 2009/0025738 | A1* | 1/2009 | Mua et al. | 131/300 |
| 2009/0025739 | A1* | 1/2009 | Brinkley et al. | 131/352 |

FOREIGN PATENT DOCUMENTS

| | | |
|---|---|---|
| EP | 2011 408 | 1/2009 |
| WO | WO 01/65954 A1 | 9/2001 |
| WO | WO 02/28209 | 4/2002 |
| WO | WO 2004/021809 | 3/2004 |
| WO | WO 2008/090477 | 7/2008 |

OTHER PUBLICATIONS

Caldwell et al., "The Nitrosation of Nictone: A Kinetic Study," *Chemical Research in Toxicology*, 4(5):513-516 (1991) (6 pages).
Caldwell et al., "Intragastric Nitrosation of Nicotine is not a Significant Contributor to Nitrosamine Exposure," *Annals of the New York Academy of Science*, 686(1):213-227 (1993).
MacKown et al., "Tobacco-Specific *N*-Nitrosamines: Formation During Processing of Midrib and Lamina Fines," *Journal of Agricultural and Food Chemistry*, 36(5):1031-1035 (1988).
Norman, Alan, "Cigarette Design and Materials," *Tobacco: Production, Chemistry and Technology*, pp. 353-387 (1999).
PCT International Search Report and Written Opinion dated Aug. 1, 2012 for PCT/EP2012/059696.

* cited by examiner

METHODS FOR REDUCING THE FORMATION OF TOBACCO SPECIFIC NITROSAMINES IN TOBACCO HOMOGENATES

This application is a U.S. National Stage Application of International Application No. PCT/EP2012/059696 filed May 24, 2012, which was published in English on Nov. 29, 2012 as International Patent Publication WO 2012/160133 A1. International Application No. PCT/EP2012/059696 also claims priority to European Application No. 11004343.7, filed May 26, 2011.

FIELD OF THE INVENTION

The present invention relates to methods for reducing or inhibiting the formation of tobacco specific nitrosamines in a tobacco homogenate. Tobacco products comprising tobacco material obtained or obtainable by said methods are also described.

BACKGROUND OF THE INVENTION

During the manufacture and processing of tobacco products, by-products such as tobacco stems, leaf scraps, and tobacco dust produced during the manufacturing process (including stemming, aging, blending, cutting, drying, cooling, screening, shaping and packaging) are produced and can be recycled to reclaim their useful tobacco content. For example, tobacco stems and tobacco fines from manufacturing processes are unsuitable for use directly in the manufacturing of tobacco products. Since the stems and fines represent a substantial amount of raw material investment, processes have been developed to further convert these stems and fines into products such as reconstituted tobacco sheets which are then useable in relatively large amounts in a mixture with acceptable processed tobacco leaf. "Reconstituted tobacco" is manufactured in a slurry or cast sheet process wherein pulp of mashed tobacco stems and other parts of the tobacco leaf are ground and mixed with a solution that might contain different additives. The resulting tobacco slurry is then sprayed to form a thin film, dried, rolled and diced into strips which are added to a filler.

Nitrosamines are organic compounds found in many consumer products, such as tobacco, food products and cosmetics. Nitrosamines have drawn intense scientific interest because some of the compounds in this class have been shown to be carcinogenic in laboratory animals. It has been reported that air-cured and flue-cured tobaccos contain tobacco specific nitrosamines which can be found in smokeless tobacco, mainstream smoke and side stream smoke of cigarettes. In tobacco, four species of nitrosamines are produced at appreciable quantity. These are 4-(methylnitrosamino)-1-(3-pyridyl)-1-butanone, N-nitrosonornicotine, N-nitrosoanatabine, and N-nitrosoanabasine. Tobacco specific nitrosamines are not considered to be present in significant quantities in growing tobacco plants or fresh cut tobacco (green tobacco), but can be formed during the curing process. In addition to the formation of tobacco specific nitrosamines during the curing process of green leaves, tobacco specific nitrosamines may also be formed during processes used to prepare aqueous tobacco slurries—such as processes used to prepare reconstituted tobacco.

In an attempt to reduce tobacco specific nitrosamines, various treatments of tobacco plants or harvested tobacco leaves have been suggested, including radiation treatments, chemical treatments and extractions. Other methods for reducing tobacco specific nitrosamines have been suggested by MacKown et al. (1988) *J. Agric. Food Chem.* 36, 1031-1035. these methods are treatment by sterilization, with microbial inhibitors, with bases to increase pH, or with ascorbic acid to decrease the accumulation of tobacco specific nitrosamines during the production of reconstituted tobacco sheets. However, MacKown et al. (1988) only considered the formation of 4-(methylnitrosamino)-1-(3-pyridyl)-1-butanone (abbreviated as NNK), N-nitrosonornicotine (abbreviated as NNN) and N-nitrosoanatabine (abbreviated as NAT) in their study. Moreover, whilst the authors considered the effect of pH on the levels of these compounds in tobacco slurries, no significant difference was seen in the level of 4-(methylnitrosamino)-1-(3-pyridyl)-1-butanone during the treatments.

A need currently remains for an effective and cost efficient method for reducing tobacco specific nitrosamines, particularly those tobacco specific nitrosamines that are formed during the preparation of tobacco homogenates—such as aqueous tobacco slurries. In particular, there is a need for a method that can be used to reduce all four species of tobacco specific nitrosamines in tobacco homogenates (that is, 4-(methylnitrosamino)-1-(3-pyridyl)-1-butanone and N-nitrosonornicotine and N-nitrosoanabasine and N-nitrosoanatabine).

SUMMARY OF THE INVENTION

The present invention is based, at least in part, on the surprising finding that the levels of tobacco specific nitrosamines (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) and particularly de novo produced tobacco specific nitrosamines, can be decreased in a tobacco homogenate by increasing the pH of the tobacco homogenate. The inventors have also discovered that the addition of nitrite to a tobacco homogenate leads to the de novo generation of tobacco specific nitrosamines in tobacco homogenates and that a greater reducing effect of increased pH is seen at elevated nitrite levels. Thus, without wishing to be bound by any particular theory, it is believed that increasing the pH of a tobacco homogenate reduces or inhibits the de novo tobacco specific nitrosamine generation in tobacco homogenates. Thus, the present invention may provide an effective means for reducing elevated levels of de novo generated tobacco specific nitrosamines and particularly those de novo generated tobacco specific nitrosamines caused by elevated nitrite levels.

In one aspect, there is provided a method for reducing the formation of one or more tobacco specific nitrosamines (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in a tobacco homogenate comprising the steps of: (a) providing a tobacco homogenate; (b) increasing the pH of the tobacco homogenate to at least about pH 6.0; (c) optionally measuring the concentration of the one or more tobacco specific nitrosamines (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in the tobacco homogenate before and after the pH treatment; and (d) obtaining a tobacco homogenate in which the level of the tobacco specific nitrosamine(s) is reduced following the pH treatment as compared to the level of the tobacco specific nitrosamine(s) in the tobacco homogenate prior to increasing the pH.

In another aspect, there is provided a method for reducing the formation of one or more tobacco specific nitrosamines (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in a tobacco homogenate comprising the steps of: (a) providing a tobacco homogenate comprising nitrite at a concentration greater than about 0.45 mM; (b) increasing the pH of the tobacco homogenate to at least about pH 6.0; and (c) obtaining a tobacco homogenate in which the level of the one or more tobacco specific nitrosamines(s) is reduced as compared to the level of the tobacco specific nitrosamines(s) in the tobacco homogenate prior to increasing the pH of the tobacco homogenate.

In one embodiment, the level of pH is controlled by use of a buffer at about pH 6.0 or which is greater than pH6.0, to make the tobacco homogenate.

In one embodiment or combination of embodiments, the tobacco homogenate is a cured tobacco homogenate.

In one embodiment or combination of embodiments, the tobacco homogenate is a tobacco slurry.

In one embodiment or combination of embodiments, the tobacco specific nitrosamines content in the tobacco homogenate provided in step (a) exceeds that of the tobacco material from which the tobacco homogenate is produced.

In one embodiment or combination of embodiments, the tobacco specific nitrosamines that are reduced are de novo generated tobacco specific nitrosamines that are not present in the tobacco feedstock used to prepare the tobacco homogenate in step (a).

In one embodiment or combination of embodiments, the nitrite concentration in the tobacco homogenate in step (a) is greater than 0.45 mM, at least about 1 mM, at least about 10 mM or at least about 50 mM.

In one embodiment or combination of embodiments, the nitrite concentration in the tobacco homogenate provided in step (a) is greater than about 0.45 mM.

In one embodiment or combination of embodiments, the tobacco homogenate in step (a) is below 25° C., at about 25° C., or at a temperature in the range that is greater than 25° C. to less than 50° C.

In one embodiment or combination of embodiments, said method comprises a step of measuring the concentration of nitrite in the tobacco homogenate, and proceeding only if the nitrite concentration is greater than 0.45 mM, at least about 1 mM, at least about 10 mM or at least about 50 mM.

In one embodiment or combination of embodiments, the pseudooxynicotine concentration in the tobacco homogenate in step (a) is at least about 100 μg/g or at least about 250 μg/g.

In one embodiment or combination of embodiments, said method comprises the further step after step (b) of measuring the levels of one or more of the tobacco specific nitrosamines in the tobacco homogenate; and the optional further step of comparing the levels of the one or more tobacco specific nitrosamines in the tobacco homogenate obtained after step (b) with the levels of the one or more tobacco specific nitrosamines in the tobacco homogenate in step (a).

In one embodiment or combination of embodiments, said method comprises the further step after step (c) of comparing the levels of the tobacco specific nitrosamines in the tobacco homogenate obtained after step (c) with the levels of the one or more tobacco specific nitrosamines in the tobacco homogenate provided in step (a).

In one embodiment or combination of embodiments, said method comprises the further step of incorporating the tobacco homogenate in which the level of tobacco specific nitrosamines(s) is reduced into a tobacco product.

In one embodiment or combination of embodiments, the tobacco product is a reconstituted tobacco product.

In one embodiment or combination of embodiments, the reconstituted tobacco product is a reconstituted tobacco sheet.

In one embodiment or combination of embodiments, the method comprises the further steps of: (i) casting the tobacco homogenate into one or more sheets; (ii) drying the cast sheet(s); and (iii) optionally incorporating the sheet(s) into a tobacco product.

Another aspect relates to a method for reducing the formation of de novo generated tobacco specific nitrosamine (s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in a tobacco homogenate comprising the steps of: (a) providing a tobacco homogenate and measuring the concentration of the tobacco specific nitrosamine(s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) therein; (b) increasing the pH of the tobacco homogenate to at least about pH 6.0; (c) incubating the tobacco homogenate under conditions that are suitable for nitrosation to occur and measuring the concentration of the tobacco specific nitrosamine(s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) therein; and (d) obtaining a tobacco homogenate in which the concentration of the tobacco specific nitrosamine (s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in step (c) is reduced as compared to the concentration of the tobacco specific nitrosamine(s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in step (a).

Suitably, the concentration of nitrite in the tobacco homogenate provided in step (a) is at least about 0.45 mM, at least about 1 mM, at least about 10 mM or at least about 50 mM.

In a further aspect, there is provided a tobacco homogenate obtained or obtainable by the method described herein.

In a further aspect, there is provided a tobacco product comprising the tobacco homogenate.

In a further aspect, there is provided a processed tobacco homogenate, wherein (i) the pH of said tobacco homogenate is at least about pH 6.0; (ii) the nitrite concentration of said tobacco homogenate is at least about 10 mM; and (iii) the total tobacco specific nitrosamine content of said tobacco homogenate is less than 8000 ng/g.

In another aspect, there is provided a method for making a tobacco product comprising providing a tobacco homogenate prepared according to the embodiments and combinations of embodiments described above, and forming the tobacco product with the tobacco homogenate. In one embodiment, the tobacco homogenate is reconstituted tobacco sheet.

In another aspect, there is provided a method for reducing the de novo or in vivo or in vitro generation of tobacco specific nitrosamine(s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in a tobacco homogenate comprising the use of a reagent that increases the pH of the tobacco homogenate to greater than about pH 6.0.

In a further aspect, there is provided the use of a reagent that increases the pH of a tobacco homogenate to greater than about pH 6.0 for reducing the de novo or in vivo or in vitro generation of tobacco specific nitrosamine(s) (for example, 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine) in a tobacco homogenate.

Each of the embodiments and combinations of embodiments described above are embodiments of each of the aspects described above.

DEFINITIONS

Figure 1:
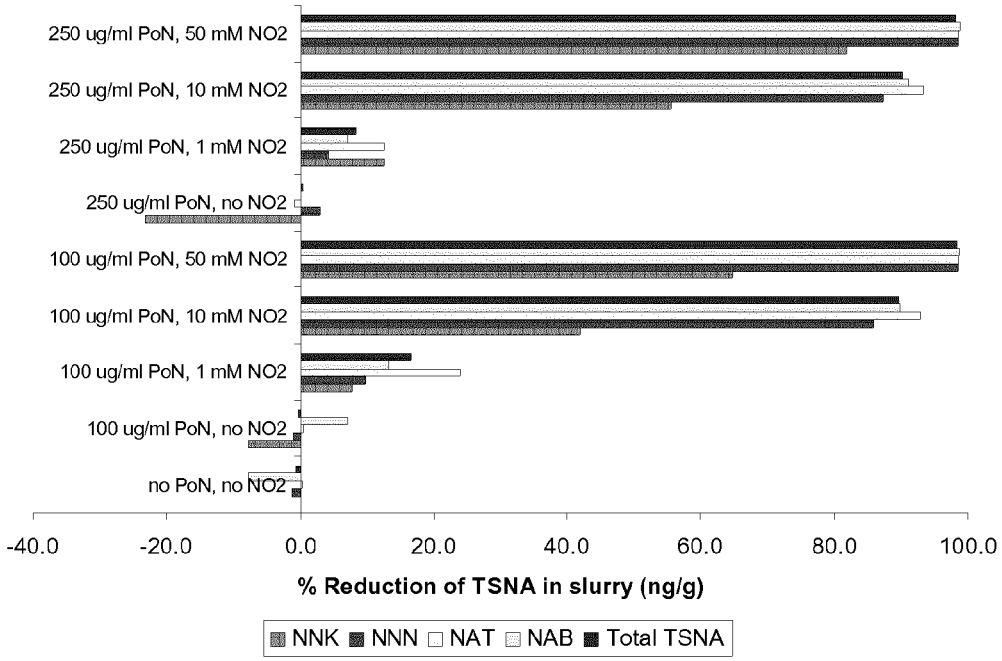
FIG. 1 illustrates the percentage reduction in 4-(methylnitrosamino)-1-(3-pyridyl)-1-butanone, N-nitrosonornicotine, N-nitrosoanatabine and N-nitrosoanabasine and total tobacco specific nitrosamine content of a tobacco slurry by adjusting the pH from pH 5.7 to pH 7.0 at nitrite concentrations ranging from 0 to 50 mM and pseudooxynicotine of from 0 to 250 μg/ml.

The technical terms and expressions used within the scope of this application are generally to be given the meaning commonly applied to them in the pertinent art of plant and molecular biology. All of the following term definitions apply to the complete content of this application. The word "comprising" does not exclude other elements or steps, and the indefinite article "a" or "an" does not exclude a plurality. A single step may fulfill the functions of several features recited in the claims. The terms "essentially", "about", "approximately" and the like in connection with an attribute or a value particularly also define exactly the attribute or exactly the value, respectively. The term "about" in the context of a given numerate value or range refers to a value or range that is within 20%, within 10%, or within 5% of the given value or range.

The terms "reduce", "reduced" "inhibit" or "inhibited" as used herein, includes a reduction of at least about 5%, 10%, at least 20%, at least 30%, at least 40%, at least 50%, at least 60%, at least 70%, at least 75%, at least 80%, at least 90%, at least 95%, at least 98%, at least 99% or up to 100% of a quantity.

The term "tobacco homogenate" refers to any tobacco material that has been subjected to homogenization, including, but not limited to cutting and grinding, and without limitation includes homogenized tobacco. The tobacco homogenate may be prepared from whole tobacco plants that are subjected to homogenization. The tobacco homogenate may be prepared from mixtures of plant components—such as a mixture of stems and leaves—that are subjected to homogenization. In some embodiments, the tobacco homogenate has a nitrite concentration of at least 0.45 mM or at least 1 mM.

The term "tobacco material" refers to any part of a tobacco plant and includes without limitation tobacco leaf scraps, tobacco green leaf scraps, tobacco stems, tobacco dust created during tobacco processing, and tobacco leaf prime lamina strip and a combination thereof. The tobacco material can have the form of processed tobacco parts or pieces, cured and aged tobacco in essentially natural lamina or stem form, a tobacco extract or a mixture of the foregoing, for example, a mixture that combines extracted tobacco pulp with granulated cured and aged natural tobacco lamina. The tobacco material can be in solid form, in liquid form, in semi-solid form, or the like.

The term "tobacco slurry" refers to a suspension of a tobacco homogenate in an aqueous solution, for example without limitation, in water alone. The slurry includes a 5% (w/v), 10% (w/v), 15% (w/v), 20% (w/v) or 25% (w/v) mixture of tobacco homogenate in an aqueous solution.

The term "tobacco product" includes smoking or smokable articles, and smokeless tobacco products.

The term "de novo" in the context of the generation of tobacco specific nitrosamines in a tobacco homogenate refers to the tobacco specific nitrosamines that were not present in the tobacco feedstock.

The term "tobacco feedstock" refers to the raw material that is used to prepare the tobacco homogenate prior to the pH treatment described herein.

DETAILED DESCRIPTION

The present invention is applicable to the treatment of harvested tobacco that is intended for human consumption. According to one embodiment, the present invention provides methods for reducing, preventing or inhibiting the formation of one or more tobacco specific nitrosamines in tobacco, preferably during the preparation of a tobacco homogenate which is used in a tobacco product. In one embodiment, the tobacco homogenate—such as a cured tobacco homogenate or a tobacco slurry (for example, an aqueous tobacco slurry) is used in the preparation of reconstituted tobacco, such as a reconstituted tobacco sheet. Suitably, the (de novo) generation of tobacco specific nitrosamines is reduced, prevented or inhibited. The tobacco material that is to be treated according to the methods described refers to that material in which the tobacco specific nitrosamine content can become higher or is higher than that present in the tobacco feedstock. The increase in the levels of the tobacco specific nitrosamine may be caused by a nitrosation reaction that occurs during the preparation of the tobacco homogenate or during the preparation of a tobacco product derived therefrom. The tobacco specific nitrosamine content may be at least about 10%, at least about 20%, at least about 30%, at least about 40%, at least about 50%, at least about 60%, at least about 70%, at least about 80%, at least about 90%, at least about 100%, at least about 150%, at least about 200%, at least about 250%, at least about 500%, at least about 750% or even at least about 1000% higher than the tobacco specific nitrosamine content of the tobacco feedstock.

In one embodiment, the tobacco specific nitrosamine content refers to the content of 4-(methylnitrosamino)-1-(3-pyridyl)-1-butanone or N-nitrosonornicotine or N-nitrosoanabasine or N-nitrosoanatabine. In one embodiment, the combined tobacco specific nitrosamine content refers to the combined content of 4-(methylnitrosamino)-1-(3-pyridyl)-1-butanone and N-nitrosonornicotine and N-nitrosoanabasine and N-nitrosoanatabine.

In some embodiments, the combined level of 4-(methylnitrosamino)-1-(3-pyridyl)-1-butanone and N-nitrosonornicotine and N-nitrosoanabasine and N-nitrosoanatabine in the tobacco homogenate prior to pH treatment is greater than about 8000 ng/g, greater than about 10,000 ng/g, greater than about 50,000 ng/g, greater than about 75,000 ng/g, greater than about 100,000 ng/g or greater than about 125,000 ng/g.

In some embodiments, the combined level of 4-(methylnitrosamino)-1-(3-pyridyl)-1-butanone and N-nitrosonornicotine and N-nitrosoanabasine and N-nitrosoanatabine in the tobacco homogenate after pH treatment is less than about 8000 ng/g, less than about 6000 ng/g, less than about 4000 ng/g, less than about 3000 ng/g, less than about 2000 ng/g, less than about 1000 ng/g or less than about 500 ng/g.

In one embodiment, the tobacco homogenates or slurries are derived or derivable from a cured tobacco material. Processes of curing tobacco leaves, especially, green tobacco leaves are well known to those skilled in the art and include without limitation air-curing, fire-curing, flue-curing and sun-curing. The process of curing tobacco material depends on the type of tobacco harvested. For example, Virginia flue (bright) tobacco is typically flue-cured, Burley and certain dark strains are usually air-cured, and pipe tobacco, chewing tobacco, and snuff are usually fire-cured. Although tobacco material from any type of tobacco may be used, certain types of tobacco are preferred. Particularly preferred tobacco materials are selected from the group consisting of: flue-Cured, Turkish, Burley, Virginia, Maryland, Oriental, or any combination of two or more thereof. The shape of the tobacco material is not limited, however, it is preferably a finely ground tobacco material. Finely ground tobacco material typically has a particle size of from about 30 to 600 microns. Finely ground tobacco material may be obtained from any of the processes known for manufacturing tobacco products as an incidental by-product of these processes or may be obtained by a further size reduction process such as a grinding technique including impact grinding and roller grinding. Tobacco homogenates—such as but not limited to cured tobacco homogenates—may be prepared using various methods known in the art, for example, the tobacco may be in a shredded, ground, granulated, fine particulate, or powder form. The tobacco may be employed in the form of parts or pieces that have an average particle size less than that of the parts or pieces of shredded tobacco used in so-called "fine cut" tobacco products. If the tobacco is formed into very finely divided tobacco particle or piece then they may be sized to pass through a screen of about 18 Tyler mesh, about 20 Tyler mesh, about 50 Tyler mesh, about 60 Tyler mesh, about 100 Tyler mesh, or about 200 Tyler mesh or more. If desired, differently sized tobacco homogenates may be mixed together. Suitably, tobacco homogenates are ground or pulverized into a powder type of form using equipment and techniques for grinding, milling, or the like. Suitably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent.

The tobacco homogenate may be formed with parts of the tobacco leaves—such as the lamina and stems or with tobacco stems, tobacco leaves and tobacco dust.

The tobacco homogenate may be in the form of a tobacco slurry or a cured tobacco slurry, and may be prepared by mixing finely grounded tobacco material with an aqueous solution, for example, using water alone or using a buffer such that the pH thereof is increased to at least about pH 6.0 (for example, pH 6.1, pH 6.2, pH 6.3, pH 6.4, pH 6.5, pH 6.6, pH 6.7, pH 6.8, pH 6.9) or pH 7.0 or more. The aqueous solution may be, for example, a 5% (w/v), 10% (w/v), 15% (w/v) or 20% (w/v) or more aqueous mixture. In one embodiment, the tobacco slurry is a 10% (w/v) aqueous mixture.

In one embodiment, the method comprises the step of measuring the concentration of nitrite in the tobacco homogenate, and proceeding with the method only if the nitrite concentration is greater than about 0.45 mM. Accordingly, the method can comprise a step of providing a tobacco homogenate comprising greater than about 0.45 mM, 0.5 mM, 0.6 mM, 0.7 mM, 0.8 mM, 0.9 mM or about 1 mM nitrite or higher, prior to increasing its pH.

Prior to the adjustment of the pH, the homogenate may be incubated, for example, the homogenate may be incubated in an aqueous solution for at least about 30 minutes, at least about 1 hour, at least about 2 hours or at least about 3 hours at, for example, at about 25° C. with optionally stirring. The pH of the homogenate may then be adjusted as described herein in order to inhibit the (de novo) formation of one or more tobacco specific nitrosamines in the tobacco. The incubation conditions may be conditions under which nitrosation of the tobacco homogenate can occur.

In one embodiment, the pH is adjusted such that it is higher than the pH of the tobacco homogenate prior to adjustment according to the methods described. The typical pH of a tobacco homogenate prior to increasing the pH is about pH 5.7.

According to one embodiment, the pH is increased to at least about pH 6.0, at least about pH 6.1, at least about pH 6.2, at least about pH 6.3, at least about pH 6.4, at least about pH 6.5, at least about pH 6.6, at least about pH 6.7, at least about pH 6.8, at least about pH 6.9, at least about pH 7.0, at least about pH 7.1, at least about pH 7.2, at least about pH 7.3, at least about pH 7.4, at least about pH 7.5, at least about pH 7.6, at least about pH 7.7, at least about pH 7.8, at least about pH 7.9, at least about pH 8.0, at least about pH 8.5, at least about pH 9.0, at least about pH 9.5, at least about pH 10.0, at least about pH 10.5, at least about pH 11.0, at least about pH 11.5, or at least about pH 12.

According to another embodiment, the pH is increased to between about pH 6.0 to about pH 12.0; to between about pH 6.0 to about pH 11.5; to between about pH 6.0 to about pH 11.0; to between about pH 6.0 to about pH 10.5; to between about pH 6.0 to about pH 10; to between about pH 6.0 to about pH 9.5; to between about pH 6.0 to about pH 9.0; to between about pH 6.0 to about pH 8.5; to between about pH 6.0 to about pH 8.0; to between about pH 6.0 to about pH 7.5; to between about pH 6.0 to about pH 7.0.

According to another embodiment, the pH is increased to between about pH 7.0 to about pH 12.0; to between about pH 7.0 to about pH 11.5; to between about pH 7.0 to about pH 11.0; to between about pH 7.0 to about pH 10.5; to between about pH 7.0 to about pH 10; to between about pH 7.0 to about pH 9.5; to between about pH 7.0 to about pH 9.0; to between about pH 7.0 to about pH 8.5; to between about pH 7.0 to about pH 8.0; to between about pH 7.0 to about pH 7.5.

According to another embodiment, the pH is increased to between about pH 7.5 to about pH 12.0; to between about pH 7.5 to about pH 11.5; to between about pH 7.5 to about pH 11.0; to between about pH 7.5 to about pH 10.5; to between about pH 7.5 to about pH 10; to between about pH 7.5 to about pH 9.5; to between about pH 7.5 to about pH 9.0; to between about pH 7.5 to about pH 8.5; to between about pH 7.5 to about pH 8.0.

According to another embodiment, the pH is increased to between about pH 8.0 to about pH 12.0; to between about pH 8.0 to about pH 11.5; to between about pH 8.0 to about pH 11.0; to between about pH 8.0 to about pH 10.5; to between about pH 8.0 to about pH 10; to between about pH 8.0 to about pH 9.5; to between about pH 8.0 to about pH 9.0; to between about pH 8.0 to about pH 8.5.

According to another embodiment, the pH is increased to between about pH 8.5 to about pH 12.0; to between about pH 8.5 to about pH 11.5; to between about pH 8.5 to about pH 11.0; to between about pH 8.5 to about pH 10.5; to between about pH 8.5 to about pH 10; to between about pH 8.5 to about pH 9.5; to between about pH 8.5 to about pH 9.0.

According to another embodiment, the pH is increased to equal to or greater than about pH 6.0 but less than about pH 12.0; preferably, less than about pH 11.5, preferably, less than about pH 11.0; preferably, less than about pH 10.5; preferably, less than about pH 10; preferably, less than about pH 9.5; preferably, less than about pH 9.0; preferably, less than about pH 8.5; preferably, less than about pH 8.0; preferably, less than about pH 7.5; and preferably, less than about pH 7.0. According to this embodiment, the pH may be equal to or greater than about pH 6.5, equal to or greater than about pH 7.0, equal to or greater than about pH 7.5, equal to or greater than about pH 8.0, equal to or greater than about pH 8.5, equal to or greater than about pH 9.0, equal to or greater than about pH 9.5, equal to or greater than about pH 10.0, equal to or greater than about pH 10.5, equal to or greater than about pH 11.0, equal to or greater than about pH 11.5, equal to or greater than about pH 12.0.

The pH of the tobacco homogenate may be increased using conventional methods that are well known in the art. By way of example, one or more bases may be added to increase the pH. The chemistry of the one or more bases is not limited and it may be chosen from, for example, metal carbonates, metal hydroxides, metal oxides, metal sulfates, metal borates, metal phosphates, and amines. Suitably, the metals are alkali metals, alkaline earth metals, transition metals and lanthanide metals. More suitably, the alkali metals are sodium (Na), potassium (K) or alkaline earth metals—such as for example calcium (Ca) or magnesium (Mg). Further non-limiting examples are sodium hydroxide (NaOH), potassium hydroxide (KOH), and ammonium hydroxide ($NH_4OH$).

The methods described herein may further comprise an additional step of measuring one or more of the tobacco specific nitrosamines described herein—such as 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine. For example, the levels of these compounds may be measured in the tobacco feedstock or the tobacco homogenate or the levels of these compounds may be measured in the tobacco homogenate following pH treatment. The levels of these compounds may be measured before pH treatment, during the pH treatment or at the end of the pH treatment. The levels of these compounds may be measured intermittently during the pH treatment.

The measurement step (c) may optionally be accompanied by a comparison step to compare the levels of 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine in the tobacco homogenate following step (b) as compared to the levels in the tobacco homogenate from step (a). Various methods that are known in the art may be used for measuring the tobacco specific nitrosamine—such as liquid chromatography methods or mass spectrometry techniques. Accordingly, the method for reducing the formation of one or more tobacco specific nitrosamines in a tobacco homogenate may comprise the steps of: (a) providing a tobacco homogenate; (b) increasing the pH of the tobacco homogenate to at least about pH 6.0; (c) measuring one or more of the tobacco specific nitrosamines—such as 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine; (d) optionally comparing the levels of one or more of the tobacco specific nitrosamines following step (b) with the levels in the tobacco homogenate from step (a); and (e) obtaining a tobacco homogenate in which the level of tobacco specific nitrosamines(s) is reduced as compared to the level of tobacco specific nitrosamines in the tobacco homogenate prior to increasing the pH of the tobacco homogenate.

The tobacco homogenates described herein may comprise additives that include, but are not limited to, one or more of the following components as well as combinations thereof: flavorants, organic and inorganic fillers (for example, grains, processed grains, puffed grains, maltodextrin, dextrose, calcium carbonate, calcium phosphate, corn starch, lactose, manitol, xylitol, sorbitol, finely divided cellulose, and the like), binders (for example, povidone, sodium carboxymethylcellulose and other modified cellulosic types of binders, sodium alginate, xanthan gum, starch-based binders, gum arabic, lecithin, and the like), colorants (for example, dyes and pigments, including caramel coloring and titanium dioxide, and the like), humectants (for example, glycerin, propylene glycol, and the like), oral care additives, preservatives (for example, potassium sorbate, and the like), syrups (for example, honey, high fructose corn syrup, and the like used as flavorants), and disintegration aids (for example, microcrystalline cellulose, croscarmellose sodium, crospovidone, sodium starch glycolate, pregelatinized corn starch, and the like). Such additives are known to those having skill in the art and may be present in amounts and in forms known in the art.

Without being bound by any particular theory, tobacco specific nitrosamines, in addition to their formation during curing, are understood to be formed during the processing of tobacco homogenates—such as tobacco slurries—due to the nitrosation of alkaloids. As described herein, it has been found that at high nitrite concentrations—such as at greater than about 0.45 mM nitrite, at least about 1 mM nitrite, at least about 5 mM nitrite, at least about 10 mM nitrite, at least about 15 mM nitrite, at least about 20 mM nitrite, at least about 25 mM nitrite or at least about 50 mM nitrite—nitrosation of alkaloids occurs which can give rise to supplementary tobacco specific nitrosamine formation in the tobacco homogenate (referred to herein as de novo generated tobacco specific nitrosamines). Therefore, the methods described herein may be particularly efficient for reducing, preventing or inhibiting the formation of (de novo) generated tobacco specific nitrosamines in a tobacco product prepared from cured tobacco or a tobacco slurry in which high tobacco specific nitrosamine levels may accumulate, for example, under high nitrite concentrations. The method described herein may be particularly suitable for the preparation of reconstituted tobacco.

Typically, the total tobacco specific nitrosamine content in the tobacco homogenate that is treated according to the present invention will exceed that of the tobacco feedstock since the tobacco specific nitrosamine concentration will have increased during the processing of the tobacco homogenate. In addition to the increased tobacco specific nitrosamine concentration, elevated nitrite or pseudooxynicotine levels or a combination thereof can be present in the tobacco homogenate prior to treatment.

According to another embodiment, the total nitrite content of the tobacco homogenate prior to adjustment of the pH is at least about 0.45 mM, at least about 1 mM, at least about 5 mM, at least about 10 mM, at least about 15 mM, at least about 20 mM, at least about 25 mM, at least about 30 mM, at least about 35 mM, at least about 40 mM, at least about 45 m, at least about 50 mM, at at least about 60 mM, at least about 70 mM, at least about 80 mM, at least about 90 mM or at least about 100 mM. According to a specific embodiment, the nitrite concentration is at least about 0.45 mM. According to a specific embodiment, the nitrite concentration is at least about 1 mM. According to another specific embodiment, the nitrite concentration is at least about 10 mM. According to another specific embodiment, the nitrite concentration is at least about 50 mM.

According to another embodiment, the total pseudooxynicotine concentration of the tobacco homogenate prior to adjustment of the pH is at least about 100 μg/g, at least about 125 μg/g, at least about 150 μg/g, at least about 175 μg/g, at least about 200 μg/g, at least about 225 μg/g or at least about 250 μg/g.

According to another embodiment, the nitrite concentration is at least about 0.45 mM and the total pseudooxynicotine concentration of the tobacco homogenate is at least about 100 μg/g, at least about 125 μg/g, at least about 150 μg/g, at least about 175 μg/g, at least about 200 μg/g, at least about 225 μg/g or at least about 250 μg/g prior to adjustment of the pH.

According to another embodiment, the nitrite concentration is at least about 1 mM and the total pseudooxynicotine concentration of the tobacco homogenate is at least about 100 μg/g, at least about 125 μg/g, at least about 150 μg/g, at least about 175 μg/g, at least about 200 μg/g, at least about 225 μg/g or at least about 250 μg/g prior to adjustment of the pH.

According to another embodiment, the nitrite concentration is at least about 10 mM and the total pseudooxynicotine concentration of the tobacco homogenate is at least about 100 μg/g, at least about 125 μg/g, at least about 150 μg/g, at least about 175 μg/g, at least about 200 μg/g, at least about 225 μg/g or at least about 250 μg/g prior to adjustment of the pH.

According to another embodiment, the nitrite concentration is at least about 50 mM and the total pseudooxynicotine concentration of the tobacco homogenate is at least about 100 μg/g, at least about 125 μg/g, at least about 150 μg/g, at least about 175 μg/g, at least about 200 μg/g, at least about 225 μg/g or at least about 250 μg/g prior to adjustment of the pH.

As discussed above, cured tobaccos can contain elevated levels of tobacco specific nitrosamines which may be formed during processes used to prepare aqueous tobacco slurries—such as the processes used to prepare reconstituted tobacco. Accordingly, preferred embodiments of this invention relate to reducing or inhibiting the formation or accumulation of tobacco specific nitrosamines during such processes. Thus, according to one embodiment, there is provided a method for reducing the formation of one or more tobacco specific nitrosamines in cured tobacco comprising the steps of: (a) providing a cured tobacco homogenate; (b) increasing the pH of the cured tobacco homogenate to at least about pH 6.0; and (c) obtaining a cured tobacco homogenate in which the level of tobacco specific nitrosamine(s)—such as (de novo) generated tobacco specific nitrosamine(s)—is reduced as compared to the level of tobacco specific nitrosamines in the cured tobacco homogenate prior to increasing the pH of the cured tobacco homogenate.

According to another embodiment, there is provided a method for reducing the formation of one or more tobacco specific nitrosamines in cured tobacco comprising the steps of: (a) providing a cured tobacco homogenate; (b) increasing the pH of the cured tobacco homogenate to at least about pH 6.0; (c) optionally measuring one or more of the tobacco specific nitrosamines—such as 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine in the cured tobacco homogenate from step (b); (d) optionally comparing the levels of one or more of the tobacco specific nitrosamines in the cured tobacco homogenate from step (b) with the levels in the tobacco homogenate from step (a); and (e) obtaining a cured tobacco homogenate in which the level of tobacco specific nitrosamine(s)—such as (de novo) generated tobacco specific nitrosamine(s)—is reduced as compared to the level of tobacco specific nitrosamines in the cured tobacco homogenate prior to increasing the pH of the cured tobacco homogenate.

According to another embodiment of this invention, there is provided a method for reducing the formation of one or more tobacco specific nitrosamines in a tobacco slurry or a cured tobacco slurry comprising the steps of: (a) providing a tobacco slurry or a cured tobacco slurry; (b) increasing the pH of the tobacco slurry or the cured tobacco slurry to at least about pH 6.0; (c) optionally measuring one or more of the tobacco specific nitrosamines—such as 4-(methylnitrosamino)-1-(3-pyridyl)-1-butanone or N-nitrosonornicotine or N-nitrosoanabasine or N-nitrosoanatabine, or 4-(methylnitrosamino)-1-(3-pyridyl)-1-butanone and N-nitrosonornicotine and N-nitrosoanabasine and N-nitrosoanatabine in the treated tobacco slurry or a cured tobacco slurry from step (b); (d) optionally comparing the levels of the one or more of the tobacco specific nitrosamines in the tobacco slurry or the cured tobacco slurry following step (b) with the levels in the tobacco slurry or the cured tobacco slurry from step (a); and (e) obtaining a tobacco slurry or a cured tobacco slurry in which the level of tobacco specific nitrosamine(s)—such as (de novo) generated tobacco specific nitrosamine(s)—is reduced as compared to the level of tobacco specific nitrosamines in the tobacco slurry or the cured tobacco slurry prior to increasing the pH of the tobacco slurry or the cured tobacco slurry.

The tobacco homogenate obtained or obtainable by the methods described herein may be incorporated into various consumable products—such as tobacco products. Also described herein are tobacco products formed from the tobacco homogenate obtained or obtainable by the methods described herein. Also encompassed are methods for making such tobacco products. Tobacco products include without limitation smoking articles or smokable articles and smokeless tobacco products, including non-combustible products, heated products, and aerosol-generating products. Non-limiting examples of smoking or smokable articles include cigarettes, cigarillos, cigars and pipe tobaccos. Non-limiting examples of smokeless tobacco products include chewing tobaccos, snuffs, and substrates for use in aerosol-generating products. Smokeless tobacco products may comprise tobacco in any form, including as dried particles, shreds, granules, powders, or a slurry, deposited on, mixed in, surrounded by, or otherwise combined with other ingredients in any format, such as flakes, films, tabs, foams, or beads. Liquid contents of smokeless tobacco products can be contained in a device or enclosed in a form, such as beads, to preclude interaction with a water-soluble wrapper. The wrapper may be shaped as a pouch to partially or completely enclose tobacco-incorporating compositions, or to function as an adhesive to hold together a plurality of tabs, beads, or flakes of tobacco. Exemplary materials for constructing a wrapper include film compositions comprising HPMC, CMC, pectin, alginates, pullulan, and other commercially viable, edible film-forming polymers. Other wrapping materials may include pre-formed capsules produced from gelatin, HPMC, starch/carrageenan, or other commercially available materials. Such wrapping materials may include tobacco as an ingredient. Wrappers that are not orally disintegrable may be composed of woven or nonwoven fabrics, of coated or uncoated paper, or of perforated or otherwise porous plastic films. Wrappers may incorporate flavouring or colouring agents. Smokeless products can be assembled together with a wrapper utilizing any method known to persons skilled in the art of commercial packaging, including methods such as blister packing, in which a small package can be formed by a vertical form/fill/seal packaging machine.

According to one embodiment, the tobacco homogenate obtained or obtainable by the methods described herein may be formed into a tobacco sheet—such as a reconstituted tobacco sheet. According to this embodiment, the method may comprise the steps of: (i) obtaining a tobacco homogenate in which the level of tobacco specific nitrosamine(s) is reduced as compared to the level of tobacco specific nitrosamines in the tobacco homogenate prior to increasing the pH of the tobacco homogenate according to the method described herein; (ii) preparing a slurry of the tobacco homogenate; (iii) casting the slurry of the tobacco homogenate; and iii) drying the slurry of the tobacco homogenate to form a reconstituted tobacco sheet.

According to another embodiment, the method may comprise the steps of: (i) preparing a tobacco slurry according to the present invention in which the level of tobacco specific nitrosamine(s) is reduced as compared to the level of tobacco specific nitrosamines in the tobacco slurry prior to increasing the pH of the tobacco homogenate according to the method described herein; (ii) casting the slurry of the tobacco homogenate; and iii) drying the slurry of the tobacco homogenate to form a tobacco sheet.

The step of casting the slurry of the tobacco homogenate may be performed using any of the casting or paper making processes that are known in the art. By way of example, casting processes are described in U.S. Pat. No. 5,724,998 and U.S. Pat. No. 5,584,306; paper-making processes are described in U.S. Pat. No. 4,341,228; U.S. Pat. No. 5,584,306 and U.S. Pat. No. 6,216,706. Casting processes typically include casting the slurry onto a continuous stainless steel belt, drying the cast slurry to form a reconstituted tobacco sheet and removing said sheet. Paper-making processes typically include casting the aqueous slurry from a head box onto a wire screen for forming the desired sheet. The aqueous slurry may be separated into a soluble portion and a fibrous portion. Water is drained from the fibrous portion and a sheet is so-formed is subsequently treated and dried.

Typically, the methods described are conducted at a temperature of between about 20° C. and about 35° C.—such as between about 20° C. and about 30° C., between about 21° C. and about 29° C., between about 22° C. and about 28° C., between about 23° C. and about 27° C., between about 24° C. and about 26° C., suitably about 25° C.

The tobacco slurries may further comprise one or more binders—such as gums and pectins. As described above, tobacco slurries that are used to prepare reconstituted tobacco sheets may further comprise common additives that include, but are not limited to, one or more of the following components as well as combinations of these: wood cellulose fibers, aerosol formers, sugars, and flavorants and binders. Additives of the list described above are known to those having skill in the art and may be present in these aqueous slurries in amounts and in forms known in the art.

Once prepared, the reconstituted tobacco sheets described herein may be cut in a similar fashion as whole leaf tobacco to produce tobacco filler suitable for cigarettes and other tobacco products. The reconstituted tobacco sheets described herein may be further trashed or flayed with mechanical fingers into sized pieces similar to natural tobacco lamina strips or cut into diamond shaped pieces, between about 50 to 100 mm on a side. The reconstituted tobacco sheet pieces described herein may be further blended with other tobaccos such as flue-cured tobacco, Burley tobacco, Maryland tobacco, Oriental tobacco, rare tobacco, specialty tobacco, expanded tobacco and the like. The precise amount of each type of tobacco within a tobacco blend used for the manufacture of a particular cigarette brand varies from brand to brand. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999). The entire blend may then be shredded into a cut filler and incorporated into a tobacco product. Accordingly, methods are provided for making a tobacco product comprising tobacco homogenate (for example, reconstituted tobacco sheet) with reduced amounts of tobacco specific nitrosamines.

The tobacco homogenate may be derived from a naturally occurring tobacco plant, a mutant tobacco plant, a non-naturally occurring tobacco plant or a transgenic tobacco plant.

The tobacco homogenates described herein are derived from tobacco plants, which include plants of the genus *Nicotiana*, various species of *Nicotiana*, including *N. rustica* and *N. tabacum*. The tobacco homogenates described herein can be derived from varieties of *Nicotiana* species, commonly known as flue or bright varieties, Burley varieties, dark varieties and oriental/Turkish varieties. In some embodiments, the tobacco homogenates are derived from a Burley, Va., flue-cured, air-cured, fire-cured, Oriental, or a dark tobacco plant. In some embodiments, the tobacco homogenates are derived, for example, from one or more of the following varieties: *N. tabacum* AA 37-1, *N. tabacum* B 13P, *N. tabacum* Xanthi (Mitchell-Mor), *N. tabacum* KTRD#3 Hybrid 107, *N. tabacum* Bel-W3, *N. tabacum* 79-615, *N. tabacum* Samsun Holmes NN, F4 from cross *N. tabacum* BU21×*N. tabacum* Hoja Parado, line 97, *N. tabacum* KTRDC#2 Hybrid 49, *N. tabacum* KTRDC#4 Hybrid 110, *N. tabacum* Burley 21, *N. tabacum* PM016, *N. tabacum* KTRDC#5 KY 160 SI, *N. tabacum* KTRDC#7 FCA, *N. tabacum* KTRDC#6 TN 86 SI, *N. tabacum* PMO21, *N. tabacum* K 149, *N. tabacum* K 326, *N. tabacum* K 346, *N. tabacum* K 358, *N. tabacum* K 394, *N. tabacum* K 399, *N. tabacum* K 730, *N. tabacum* KY 10, *N. tabacum* KY 14, *N. tabacum* KY 160, *N. tabacum* KY 17, *N. tabacum* KY 8959, *N. tabacum* KY 9, *N. tabacum* KY 907, *N. tabacum* MD 609, *N. tabacum* McNair 373, *N. tabacum* NC 2000, *N. tabacum* PG 01, *N. tabacum* PG 04, *N. tabacum* PO1, *N. tabacum* PO2, *N. tabacum* PO3, *N. tabacum* RG 11, *N. tabacum* RG 17, *N. tabacum* RG 8, *N. tabacum* Speight G-28, *N. tabacum* TN 86, *N. tabacum* TN 90, *N. tabacum* VA 509, *N. tabacum* AS44, *N. tabacum* Banket A1, *N. tabacum* Basma Drama B84/31, *N. tabacum* Basma I Zichna ZP4/B, *N. tabacum* Basma Xanthi BX 2A, *N. tabacum* Batek, *N. tabacum* Besuki Jember, *N. tabacum* C104, *N. tabacum* Coker 319, *N. tabacum* Coker 347, *N. tabacum* Criollo Misionero, *N. tabacum* PM092, *N. tabacum* Delcrest, *N. tabacum* Djebel 81, *N. tabacum* DVH 405, *N. tabacum* Galpão Comum, *N. tabacum* HB04P, *N. tabacum* Hicks Broadleaf, *N. tabacum* Kabakulak Elassona, *N. tabacum* PM102, *N. tabacum* Kutsage E1, *N. tabacum* KY 14xL8, *N. tabacum* KY 171, *N. tabacum* LA BU 21, *N. tabacum* McNair 944, *N. tabacum* NC 2326, *N. tabacum* NC 71, *N. tabacum* NC 297, *N. tabacum* NC 3, *N. tabacum* PVH 03, *N. tabacum* PVH 09, *N. tabacum* PVH 19, *N. tabacum* PVH 2110, *N. tabacum* Red Russian, *N. tabacum* Samsun, *N. tabacum* Saplak, *N. tabacum* Simmaba, *N. tabacum* Talgar 28, *N. tabacum* PM132, *N. tabacum* Wislica, *N. tabacum* Yayaldag, *N. tabacum* NC 4, *N. tabacum* TR Madole, *N. tabacum* Prilep HC-72, *N. tabacum* Prilep P23, *N. tabacum* Prilep PB 156/1, *N. tabacum* Prilep P12-2/1, *N. tabacum* Yaka JK-48, *N. tabacum* Yaka JB 125/3, *N. tabacum* TI-1068, *N. tabacum* KDH-960, *N. tabacum* TI-1070, *N. tabacum* TW136, *N. tabacum* PM204, *N. tabacum* PM205, *N. tabacum* Basma, *N. tabacum* TKF 4028, *N. tabacum* L8, *N. tabacum* TKF 2002, *N. tabacum* TN90, *N. tabacum* GR141, *N. tabacum* Basma xanthi, *N. tabacum* GR149, *N. tabacum* GR153, and *N. tabacum* Petit Havana.

In a further aspect, the processed tobacco homogenate obtained by the method of the present invention has a pH of at least about pH 6.0; a nitrite concentration of greater than about 0.45 mM; and a total tobacco specific nitrosamine content (from the combination of nitrosamine 4-(methylnitrosamino)-1-(3-pyridyl)-1-butanone and N-nitrosonornicotine and N-nitrosoanabasine and N-nitrosoanatabine) of less than 8000 ng/g—such as less than 7000 ng/g, less than 6000 ng/g, less than 5000 ng/g, less than 4000 ng/g, less than 3000 ng/g, less than 2000 ng/g, less than 1500 ng/g or less than 1000 ng/g.

According to this aspect of the present invention, the processed tobacco homogenate may have a nitrite concentration of at least about 1 mM, at least about 5 mM, at least about 10 mM, at least about 15 mM, at least about 20 mM, at least about 25 mM, at least about 30 mM, at least about 35 mM, at least about 40 mM, at least about 45 m, at least about 50 mM, at at least about 60 mM, at least about 70 mM, at least about 80 mM, at least about 90 mM or at least about 100 mM.

According to this aspect of the present invention, the pH is at least about pH 6.0, at least about pH 6.1, at least about pH 6.2, at least about pH 6.3, at least about pH 6.4, at least about pH 6.5, at least about pH 6.6, at least about pH 6.7, at least about pH 6.8, at least about pH 6.9, at least about pH 7.0, at least about pH 7.1, at least about pH 7.2, at least about pH 7.3, at least about pH 7.4, at least about pH 7.5, at least about pH 7.6, at least about pH 7.7, at least about pH 7.8, at least about pH 7.9, at least about pH 8.0, at least about pH 8.5, at least about pH 9.0, at least about pH 9.5, at least about pH 10.0, at least about pH 10.5, at least about pH 11.0, at least about pH 11.5, or at least about pH 12.

According to this aspect of the present invention, the processed tobacco homogenate may have a nitrite concentration of at least about 1 mM, at least about 5 mM, at least about 10 mM, at least about 15 mM, at least about 20 mM, at least about 25 mM, at least about 30 mM, at least about 35 mM, at least about 40 mM, at least about 45 m, at least about 50 mM, at at least about 60 mM, at least about 70 mM, at least about 80 mM, at least about 90 mM or at least about 100 mM and a pH that is at least about pH 6.0, at least about pH 6.1, at least about pH 6.2, at least about pH 6.3, at least about pH 6.4, at least about pH 6.5, at least about pH 6.6, at least about pH 6.7, at least about pH 6.8, at least about pH 6.9, at least about pH 7.0, at least about pH 7.1, at least about pH 7.2, at least about pH 7.3, at least about pH 7.4, at least about pH 7.5, at least about pH 7.6, at least about pH 7.7, at least about pH 7.8, at least about pH 7.9, at least about pH 8.0, at least about pH 8.5, at least about pH 9.0, at least about pH 9.5, at least about pH 10.0, at least about pH 10.5, at least about pH 11.0, at least about pH 11.5, or at least about pH 12.

According to this aspect of the present invention, the processed tobacco homogenate may have a nitrite concentration of at least about 1 mM, at least about 5 mM, at least about 10 mM, at least about 15 mM, at least about 20 mM, at least about 25 mM, at least about 30 mM, at least about 35 mM, at least about 40 mM, at least about 45 m, at least about 50 mM, at at least about 60 mM, at least about 70 mM, at least about 80 mM, at least about 90 mM or at least about 100 mM and a pH that is at least about pH 6.0, at least about pH 6.1, at least about pH 6.2, at least about pH 6.3, at least about pH 6.4, at least about pH 6.5, at least about pH 6.6, at least about pH 6.7, at least about pH 6.8, at least about pH 6.9, at least about pH 7.0, at least about pH 7.1, at least about pH 7.2, at least about pH 7.3, at least about pH 7.4, at least about pH 7.5, at least about pH 7.6, at least about pH 7.7, at least about pH 7.8, at least about pH 7.9, at least about pH 8.0, at least about pH 8.5, at least about pH 9.0, at least about pH 9.5, at least about pH 10.0, at least about pH 10.5, at least about pH 11.0, at least about pH 11.5, or at least about pH 12; and a total tobacco specific nitrosamine content (from the combination of nitrosamine 4-(methylnitrosamino)-1-(3-pyridyl)-1-butanone and N-nitrosonornicotine and N-nitrosoanabasine and N-nitrosoanatabine) of less than 8000 ng/g—such as less than 7000 ng/g, less than 6000 ng/g, less than 5000 ng/g, less than 4000 ng/g, less than 3000 ng/g, less than 2000 ng/g, less than 1500 ng/g or less than 1000 ng/g.

The following examples are provided as an illustration and not as a limitation. Unless otherwise indicated, the present invention employs conventional techniques and methods of molecular biology and plant biology.

EXAMPLES

Example 1

Materials & Methods

Tobacco slurry is prepared by mixing finely ground Burley tobacco with sterile distilled water to obtain a 10% (w/v) mixture. The mixture is incubated for 2 hrs at room temperature while stirring with a magnetic stirring rod. The pH of the mixture is measured and then the mixture is divided into two equal parts. The pH of one of the parts is adjusted to pH 7.0 using 10N KOH. 10-ml aliquots of the unadjusted pH and the pH 7.0 mixtures are transferred into 50-ml falcon tubes and pseudooxynicotine and $KNO_2$ solutions are added to the samples to obtain the desired final composition. The samples are prepared in complete factorial design in which the factors pH, pseudooxynicotine and nitrite are used at (unadjusted 5.7, 7.0); (0, 100, 250 μg/ml); and (0, 1, 10, 50 mM) levels, respectively. Nitrosation is allowed to occur at room temperature for about 16 hrs. The alkaloid and tobacco specific nitrosamine content of the samples is analyzed by standard methods using gas chromatography-mass spectrometry or liquid chromatography-mass spectrometry techniques, or a combination thereof.

Example 2

Tobacco Specific Nitrosamine Spikes in a Tobacco Slurry are Accompanied by Elevated Nitrite Levels To determine the impact of increasing the pH of tobacco homogenate on tobacco specific nitrosamine formation, the pH of a tobacco slurry is adjusted to pH 7.0 and the tobacco specific nitrosamine content of the mixture is analysed in the presence of various levels of tobacco specific nitrosamine precursors, such as pseudooxynicotine and nitrite. The results indicate that, regardless of pH, the addition of pseudooxynicotine to the mixture significantly increases 4-(methylnitrosamino)-1-(3-pyridyl)-1-butanone levels only when ≥1 mM nitrite is also supplied to the slurry. These results suggest that in the presence of sufficiently high nitrite concentrations (for example, at least about 1 mM), pseudooxynicotine is readily converted into 4-(methylnitrosamino)-1-(3-pyridyl)-1-butanone, and in the slurry nitrite levels limit 4-(methylnitrosamino)-1-(3-pyridyl)-1-butanone formation. Although the change in tobacco specific nitrosamine levels in response to adding nornicotine, anatabine and anabasine, the amine precursors of N-nitrosonornicotine, N-nitrosoanabasine and N-nitrosoanatabine, respectively, has not been tested in the slurry, the results showed that the addition of nitrite dramatically increased the concentration of these tobacco specific nitrosamines, at nitrite concentrations >1 mM. Collectively, these results are consistent with the observations that "tobacco specific nitrosamine spikes" in the slurry are accompanied by elevated nitrite levels.

Example 3

Increasing the pH of a Tobacco Slurry Reduces the Levels of All Four Species of Tobacco Specific Nitrosamines Adjusting the pH of the slurry from its naturally-occurring value of pH 5.7 to pH 7.0 sharply decreases the levels of all four species of tobacco specific nitrosamines when >1 mM nitrite is added to the mixture. The rate of tobacco specific nitrosamine reduction is dependent on the concentrations of pseudooxynicotine and nitrite in the slurry. The greatest % of total tobacco specific nitrosamine reduction (approx. 98%) is achieved at 50 mM nitrite levels followed by 90% at 10 mM nitrite and 12% at 1 mM nitrite concentration. The reduction of individual tobacco specific nitrosamines follows the same trend as total tobacco specific nitrosamines with the exception of 4-(methylnitrosamino)-1-(3-pyridyl)-1-butanone (FIG. 1). Firstly, % reduction of 4-(methylnitrosamino)-1-(3-pyridyl)-1-butanone is smaller than the other tobacco specific nitrosamine species reaching its maximum (approx. 82%) at 250 μg/g pseudooxynicotine and 50 mM nitrite concentrations. Secondly, % reduction of 4-(methylnitrosamino)-1-(3-pyridyl)-1-butanone is not only dependent on nitrite levels, but it is also strongly impacted by the pseudooxynicotine concentration of the mixture. For example, % reduction of 4-(methylnitrosamino)-1-(3-pyridyl)-1-butanone was 65% at 100 μg/g pseudooxynicotine and 50 mM nitrite levels in contrast to 82% at 250 μg/g pseudooxynicotine and 50 mM nitrite concentration (FIG. 1).

Example 4

Increasing the pH of a Tobacco Slurry Reduces the Levels of All Four Species of Tobacco Specific Nitrosamines at 10 mM and 50 mM Nitrite The average values of total tobacco specific nitrosamine (that is, the collective amount of N-nitrosonornicotine, 4-(methylnitrosamino)-1-(3-pyridyl)-1-butanone, N-nitrosoanatabine and N-nitrosoanabasine) and the average values of specific tobacco specific nitrosamine (that is N-nitrosonornicotine, 4-(methylnitrosamino)-1-(3-pyridyl)-1-butanone, N-nitrosoanatabine or N-nitrosoanabasine) obtained from 3 tobacco specimens are given in Table 1. Values of standard error given in brackets in Table 1 are defined as (standard deviation)/[$n^{1/2}$], where n is the number of observations (n=3).

Example 5

Figure 2:
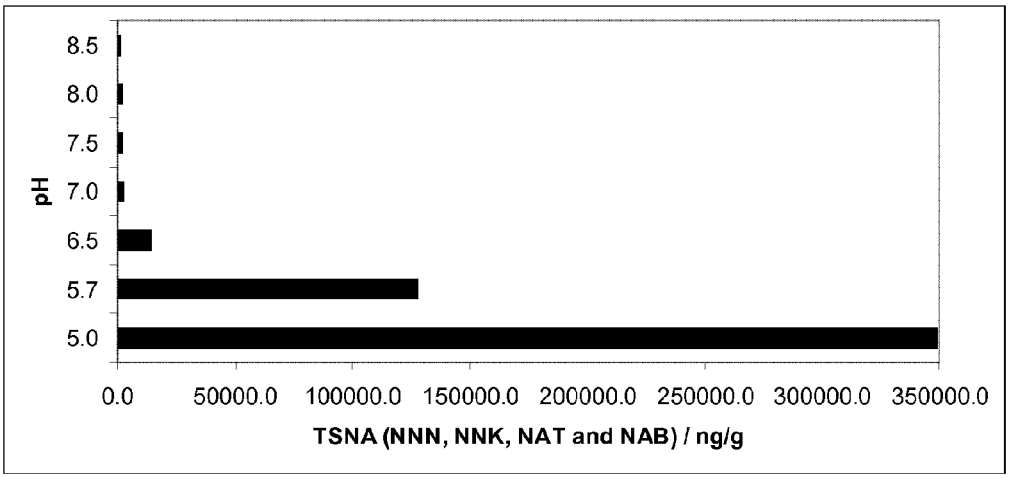
FIG. 2 illustrates the reduction, prevention or inhibition of the formation of the collective content of 4-(methylnitrosamino)-1-(3-pyridyl)-1-butanone, N-nitrosonornicotine, N-nitrosoanatabine and N-nitrosoanabasine obtained by mixing a tobacco material with an aqueous buffer at a pH of 7.0 or greater than 7.0 and at a nitrite concentration of 50 mM.

Increasing the pH of a Tobacco Slurry Reduces the Levels of All Four Species of Tobacco Specific Nitrosamines at 10 mM and 50 mM Nitrite FIG. 2 illustrates the reduction of the formation of the collective content of 4-(methylnitrosamino)-1-(3-pyridyl)-1-butanone, N-nitrosonornicotine, N-nitrosoanatabine and N-nitrosoanabasine obtained by adjusting the pH of the tobacco material to between pH 5.0 and 8.5 and at a nitrite concentration of 10 mM or 50 mM.

Any publication cited or described herein provides relevant information disclosed prior to the filing date of the present application. Statements herein are not to be construed as an admission that the inventors are not entitled to antedate such disclosures. All publications mentioned in the above specification are herein incorporated by reference. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in cellular, molecular and plant biology or related fields are intended to be within the scope of the following claims.

TABLE 1

| | pH | 4-(methylnitrosamino)-1-(3-pyridyl)-1-butanone (ng/g slurry) | N-nitrosonornicotine (ng/g slurry) | N-nitrosoanabasine (ng/g slurry) | N-nitrosoanatabine (ng/g slurry) | Total tobacco specific nitrosamine (ng/g slurry) |
|---|---|---|---|---|---|---|
| 10 mM | 5.0 | 75.0 (12.0) | 29480.5 (683.5) | 1191.0 (194.0) | 48656.0 (7942.0) | 79402.5 (14531.5) |
| $NO_2$ | 5.7 | 35.8 (2.3) | 3158.4 (335.1) | 125.4 (10.7) | 5502.9 (392.2) | 8822.5 (678.5) |
| | 6.5 | 51.3 (13.3) | 577.3 (34.0) | 18.9 (1.6) | 1041.1 (297.3) | 1688.6 (110.3) |
| | 7.0 | 39.3 (5.3) | 479.0 (8.9) | 20.3 (6.3) | 465.7 (17.0) | 1004.3 (504.8) |
| | 7.5 | 40.0 (2.6) | 612.3 (95.9) | 21.3 (4.5) | 750.3 (241.1) | 1424.0 (343.7) |
| | 8.0 | 42.3 (3.8) | 621.3 (99.7) | 20.3 (5.8) | 731.7 (273.0) | 1415.7 (381.5) |
| | 8.5 | 34.0 (0.0) | 480.0 (21.0) | 14.5 (0.5) | 432.0 (14.0) | 960.5 (34.5) |
| 50 mM | 5.0 | 462.0 (157.0) | 168668.5 (13205.5) | 10754.5 (1912.5) | 168634.5 (1305.5) | 348519.5 (13969.5) |
| $NO_2$ | 5.7 | 154.4 (35.4) | 49529.3 (5385.5) | 2239.2 (285.5) | 75824.2 (3197.9) | 127747.1 (6084.5) |
| | 6.5 | 79.7 (10.4) | 3747.2 (787.9) | 206.1 (58.5) | 10428.5 (2850.1) | 14461.5 (2705.3) |
| | 7.0 | 70.3 (21.3) | 776.4 (102.6) | 30.8 (5.5) | 1444.8 (356.5) | 2322.3 (430.4) |
| | 7.5 | 63.0 (9.8) | 699.0 (124.1) | 23.3 (4.1) | 951.0 (248.2) | 1736.3 (383.6) |
| | 8.0 | 58.3 (5.8) | 757.0 (144.8) | 25.7 (7.9) | 988.7 (390.5) | 1829.7 (543.9) |
| | 8.5 | 46.0 (4.0) | 578.5 (16.5) | 15.5 (0.5) | 486.0 (30.0) | 1126.0 (51.0) |

Values in brackets correspond to the values of standard error as defined above.

The invention claimed is:

1. A method for reducing the formation of 4-(methylnitrosamino)-1-(3-pyridyl)-1-butanone and N-nitrosonornicotine and N-nitrosoanatabine and N-nitrosoanabasine in a tobacco homogenate comprising the steps of:

(a) providing a tobacco homogenate, wherein the nitrite content in said homogenate is greater than 0.45 mN;

(b) increasing the pH of the tobacco homogenate to at least about pH 6.0; and (c) obtaining a tobacco homogenate in which the level of 4-(methylnitrosamino)-1-(3-pyridyl)-1-butanone and N-nitrosonornicotine and N-nitrosoanatabine and N-nitrosoanabasine is reduced as compared to the level of 4-(methylnitrosamino)-1-(3-pyridyl)-1-butanone and N-nitrosonornicotine and N-nitrosoanatabine and N-nitrosoanabasine in the tobacco homogenate provided in step (a).

2. The method according to claim 1, wherein the tobacco homogenate is a cured tobacco homogenate or a tobacco slurry.

3. The method according to claim 2, wherein the pseudooxynicotine concentration in the tobacco homogenate provided in step (a) is at least about 100 μg/g.

4. The method according to claim 1, wherein the pH of the tobacco homogenate is increased to between about 7.0 to about 12.0 in step (b).

5. The method according to claim 4, wherein the pseudooxynicotine concentration in the tobacco homogenate provided in step (a) is at least about 100 μg/g.

6. The method according to claim 1, wherein the nitrite concentration in the tobacco homogenate provided in step (a) is greater than about 1 mM.

7. The method according to claim 1, wherein the pseudooxynicotine concentration in the tobacco homogenate provided in step (a) is at least about 100 μg/g.

8. The method according to claim 1, wherein said method comprises the further step after step (c) of comparing the levels of the tobacco specific nitrosamines in the tobacco homogenate obtained after step (c) with the levels of the tobacco specific nitrosamines in the tobacco homogenate provided in step (a).

9. The method according to claim 1, further comprising measuring the level of 4-(methylnitrosamino)-1-(3-pyridyl)-1-butanone and N-nitrosonornicotine and N-nitrosoanatabine and N-nitrosoanabasine in the tobacco homogenate before and after the pH treatment in step (b).

10. A processed tobacco homogenate obtained or obtainable by the method of claim 1, wherein (i) the pH of said processed tobacco homogenate is at least about pH 6.0;

(ii) the nitrite concentration of said processed tobacco homogenate is greater than about 0.45 mM; and (iii) the total tobacco specific nitrosamine content of said processed tobacco homogenate is less than about 8000 ng/g.

11. A tobacco product comprising a processed tobacco homogenate according to claim 10.

12. A processed tobacco homogenate according to claim 10, wherein said total tobacco specific nitrosamine content is less than about 4000 ng/g.

13. A method for making a tobacco product comprising the steps of:

(a) providing a tobacco homogenate; wherein the nitrite content in said homogenate is greater than 0.45 mM;

(b) increasing the pH of the tobacco homogenate to at least about pH 6.0;

(c) obtaining a tobacco homogenate in which the level of 4-(methylnitrosamino)-1-(3-pyridyl)-1-butanone and N-nitroso-nornicotine and N-nitrosoanatabine and N-nitrosoanabasine is reduced as compared to the level of 4-(methylnitrosamino)-1-(3-pyridyl)-1-butanone and N-nitrosonornicotine and N-nitrosoanatabine and N-nitrosoanabasine in the tobacco homogenate provided in step (a); and (d) incorporating the tobacco homogenate in which the level of tobacco specific nitrosamine is reduced into a tobacco product.

14. The method according to claim 13, wherein the tobacco product is a reconstituted tobacco product.

15. The method according to claim 14, wherein the reconstituted tobacco product is a reconstituted tobacco sheet.

16. The method according to claim 15, wherein the method comprises the further steps of:

(i) casting the tobacco homogenate into one or more sheets; and (ii) drying the cast sheet(s).

* * * * *